United States Patent [19]

Jecmen et al.

[11] 3,943,663

[45] Mar. 16, 1976

[54] ASTRAGAL

[75] Inventors: James M. Jecmen, Brookfield; John J. Jecmen, Riverside, both of Ill.

[73] Assignee: Harris Preble Company, Cicero, Ill.

[22] Filed: Dec. 6, 1974

[21] Appl. No.: 530,206

[52] U.S. Cl. ..... 49/370; 49/488; 49/494; 49/499

[51] Int. Cl.[2] ..... E06B 7/16

[58] Field of Search ..... 49/368, 370, 493, 494, 49/488, 498, 499

[56] References Cited

UNITED STATES PATENTS

| | | | |
|---|---|---|---|
| 330,866 | 11/1885 | Bassell | 49/494 |
| 463,886 | 11/1891 | Blackwood et al. | 49/494 |
| 712,240 | 10/1902 | Barnes et al. | 49/499 X |
| 2,853,749 | 9/1958 | West | 49/499 X |
| 2,891,289 | 6/1959 | Guilbert, Jr. | 49/488 |
| 2,923,984 | 2/1960 | Jecmen | 49/494 |
| 3,462,885 | 8/1969 | Miller | 49/488 |

FOREIGN PATENTS OR APPLICATIONS

| | | | |
|---|---|---|---|
| 1,200,859 | 9/1965 | Germany | 49/498 |

*Primary Examiner*—Philip C. Kannan

*Attorney, Agent, or Firm*—Merriam, Marshall, Shapiro & Klose

[57] ABSTRACT

An improved astragal is formed by joining two layers of flexible fire-resistant material to form an envelope, which is then shaped whereby extensions of said envelope are overlapped to form a joint contiguous to a mounting bar, which mounting bar is used to affix the astragal to the elevator door.

12 Claims, 4 Drawing Figures

ASTRAGAL

The present invention relates to safety astragals for elevator doors and more particularly to safety astragals designed for use on horizontally divided, vertically moving freight elevator doors.

Elevator doors of the counterbalanced type are conventionally used at elevator landing openings to prevent fire, which might originate within the elevator shaft, from being communicated to the various floors of the building, and to prevent fires originating at the floors from being communicted to the elevator shaft. The doors are typically comprised of two separate vertically moving sections, which are positioned between vertically disposed guide rail members which are attached on walls forming the elevator shaft. The door sections are guided in their vertical opening and closing movements by guide means attached to the vertical edges of the door sections which cooperate with and engage an inwardly-extending flange member of the guide rail assembly. In opening and closing movements, the door sections move in a vertical plane in opposed relation to each other, which movement is controlled by flexible connecting members secured to each side of each door section with the flexible connecting members running over respective sheave members secured to the guide rail assemblies.

In order to provide a fire-tight seal between the two door sections, when closed, it was at one time common practice to provide a structural steel angle section on the upper door which overlapped the lower door, when the doors were in the closed position. The angle section prevented fire from passing through any space which might have existed between the doors and also prevented the introduction of objects between the doors for deposit or discharge into the shaftways. The fire seal angles, however, while they were suitable for providing a fire-tight seal, introduced a hazard upon closing the doors, since the angle also functioned as a guillotine which would tend to shear off anything left in between the doors. The steel angle sections were particularly dangerous to fingers, hands, wrists, or feet of persons who did not take sufficient care to avoid injury.

More recently, safety astragals have been proposed, which astragals are fabricated from cylinders of various fireproof materials such as wire-reinforced, neoprene-coated asbestos. In many cases the wire-reinforced, neoprene-coated cylinder astragals contained reinforcing members or spring-like devices which were elements of the apparatus used to mount the astragal on the elevator door. Such cylindrical astragals are described in U.S. Pat. No. 2,923,984, Canadian Pat. No. 524,866 (issued May 8, 1956) and elsewhere.

In order to obtain Underwriter's approval of elevator doors, the doors with the astragals mounted thereon must be subject to rigorous tests both as to their fire-resisting qualities and also their resistance to disintegration by the hose steam test which is applied immediately after the fire test. Since the forces employed in closing freight elevator doors are of the order of 35 to 50 pounds, in order to produce a neoprene-asbestos fabric cylinder which will withstand repeated stresses and compression to seal, it is necessary to build a thick and strong cylinder. It has been found that when cylindrical astragals are fabricated to specifications which produce adequate fire protection and resistance to physical stresses, they are not easily compressed. It has also been found that many injuries can occur when a finger or hand or other limb is caught between the lower sill and the astragal. Even in those cases where there is no metal-to-metal contact, serious injury can take place.

It is the purpose of the present invention to provide an astragal which is effective in producing a fire seal, but which is sufficiently flexible to avoid any crushing injury to a limb which is caught between the doors in the closed position.

The present invention also provides a safety astragal which is simple in construction and can be readily attached to new or to existing freight elevator doors and which astragal will be effective in its action and which will have a long life.

The present invention further provides an astragal which is readily fabricated, which requires a lesser amount of overall material than is required for a conventionally cylinder-type astragal, and which may be attached to the elevator door by the members which hold the astragal in its finished configuration.

Other advantages of the present invention will be readily appreciated by those skilled in the art by reference to the following description, when considered in connection with the accompanying drawing in which.

Figure 1:
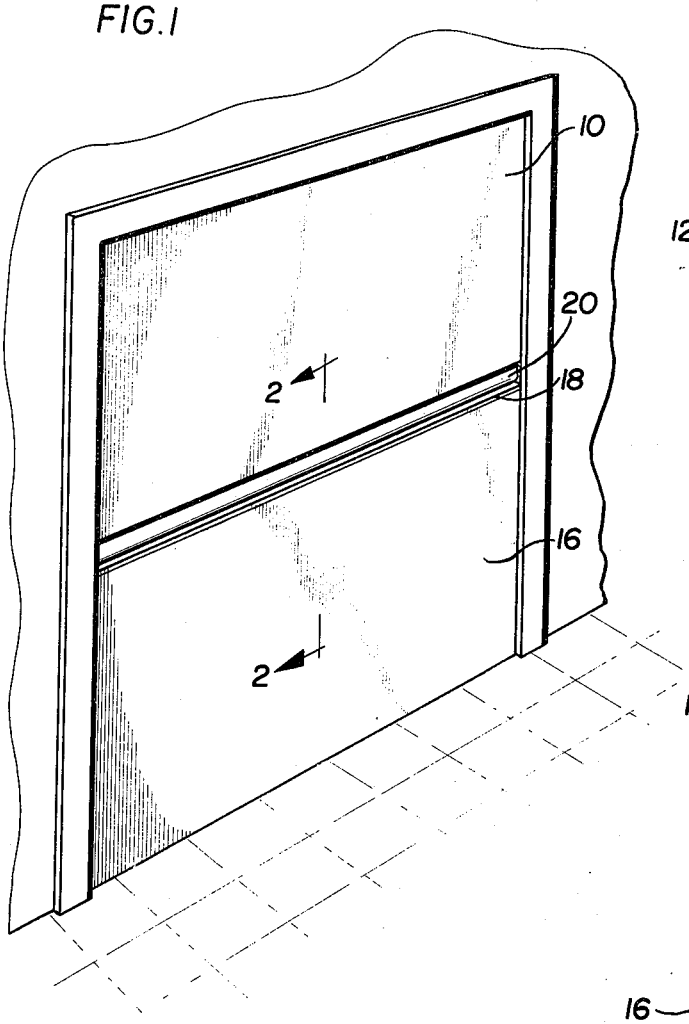
FIG. 1 is a perspective view, as seen from outside of the elevator shaft, of a pair of elevator doors, with the astragal of the present invention affixed to the lower surface of the upper door.
Figure 2:
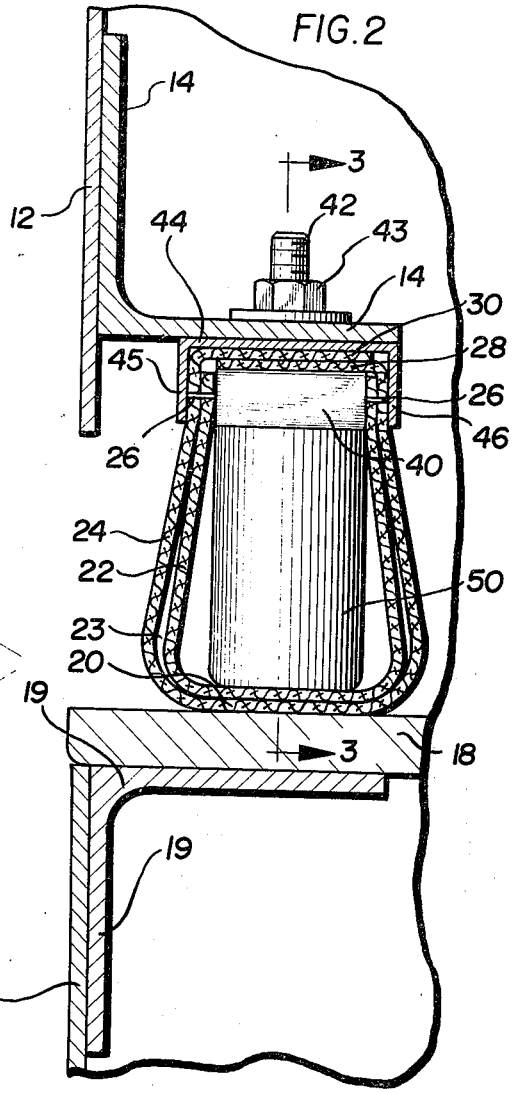
FIG. 2 is a transverse vertical sectional view of the astragal of the present invention mounted on the lower surface of the upper door of the pair of elevator doors, taken in section along line 2—2 of FIG. 1.
Figure 3:
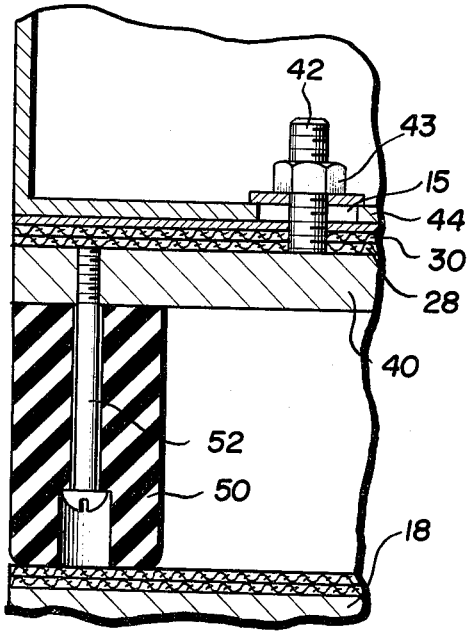
FIG. 3 is a fragmentary longitudinal view of the astragal of the present invention taken in section at approximately line 3—3 of FIG. 2.

Referring more particularly to the drawing, FIG. 1 shows a pair of horizontally divided, vertically operating freight elevator doors 10 and 16, in which upper door 10 has an astragal 20 affixed to its lower edge. As is shown in FIGS. 1, 2, and 3, the doors are in the closed position, whereby the astragal 20 is in contact with the upper member 18 of lower door 16. Those skilled in the art will be aware that the astragal of the present invention may be used in connection with a single, vertically moving door, in which case a stationary trucking sill would function in the same manner as the upper member 18 of the lower door 16.

As is shown in FIG. 2, the upper door 10 comprises a face plate 12 which is affixed to a door frame angle 14, which provides a horizontal surface to which the astragal 20 is mounted. The lower door 16 is usually similarly constructed, except that a heavy duty trucking sill 18 is typically affixed to the lower door frame angle 19 whereby the trucking sill 18 serves as the horizontal contact surface for the astragal 20.

Figure 4:
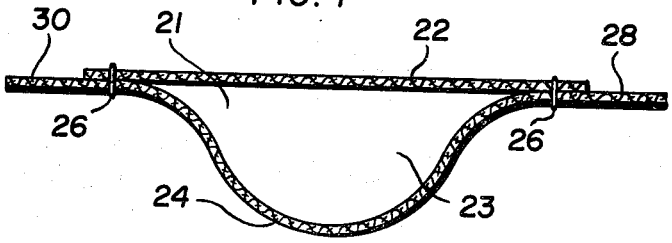
FIG. 4 is a cross-section of the envelope of flexible fireproof material used to fabricate the astragal of the present invention.

The astragal of the present invention is shown in transverse cross-section in both FIGS. 2 and 4. In FIG. 2, the astragal 20 is in place, and attached to the door, while FIG. 4 illustrates the astragal before it is shaped and mounted. As is shown in both Figures, the astragal is formed from an elongated, flexible fabric assembly 21, which comprises two discrete layers of flexible fireproof material, which preferably is a neoprene-coated, wire-reinforced asbestos cloth. Preferably, both the inner layer 22 and the outer layer 24 are produced from the same type of material.

The inner layer 22 and the outer layer 24 are joined at joints 26 along parallel lines to form an elongated envelope 23 as is shown in FIG. 4. Joints 26 are preferably secured by stitching using a non-melting thread such as cotton, but adhesives and other means may be used to produce the joints 26 and form the envelope 23. The inner layer 22 is joined near its outer edges to the outer layer 24 within the borders of the outer layer 24, leaving extensions 28 and 30 outside of both sides of the envelope. It is important that inner layer 22 be joined with outer layer 24 in such a manner that an elongated envelope or pocket 23 is formed. Flexible fabric assembly 21 should be long enough to run the entire width of the elevator door on which it is to be installed. When the fabric assembly 21 is shaped into the astragal 20, the pocket 23 provides for a dead air space between the two layers 22 and 24, which pocket 23 improves the insulating properties, i.e., fire resisting of the astragal. Further, the pocket provides for the larger radius required by the outer layer 24 during the shaping of the astragal as is shown in FIG. 2.

The extensions 28 and 30 of outer layer 24, which are formed when the envelope is formed, serve to secure the astragal to the mounting bar. Mounting bar 40 serves as a means to hold the astragal in its finished form and at the same time functions to affix the astragal to the elevator door. Mounting bar 40 is preferably fairly rigid and may be fabricated of hot rolled steel ⅜ inch by 1 inch in size, and should be the same length as the astragal.

Preferably, a series of threaded studs 42 are affixed to the upper surface of mounting bar 40. The studs 42 serve to hold the astragal in its finished form and at the same time function to affix the astragal to the upper door frame angle 14. Preferably the studs 42 are welded to mounting bar 40, but the studs may be attached to mounting bar 40 by any convenient means.

In order to form the astragal, the flexible fabric assembly 21 is shaped as is shown in FIG. 2, whereby inner layer 22 assumes a U-shaped position contiguous to the sides of mounting bar 40. The flexible fabric assembly extensions 28 and 30 overlap the upper surface of mounting bar 40, whereby extension 30 overlaps extension 28. The extensions 28 and 30 are held in place by suitably located apertures which register with the plurality of studs 42, which are affixed to the top of mounting bar 40. The studs project through apertures in extensions 28 and 30, and thereby form the shaped astragal.

Channel member 44 is adapted to fit over mounting bar 40 and the extensions 28 and 30 thereon. Apertures in channel member 44, which may be drilled or punched, are provided at suitable intervals to register with studs 42. Channel member 44 is preferably fitted over studs 42, whereby the skirt 46 of channel member 44 overlaps the sides of mounting bar 40. Preferably the skirt of channel member 44 overlaps the joint of inner layer 22 and outer layer 24 including the stitching 26 which joins those two layers. Preferably the size of channel member 44 is adequate to surround the joint 26 of fabric assembly 21 and firmly compress the joint 26 of fabric assembly 21, including the stitching portion 26 between skirt member 46 and mounting bar 40.

If desired, speed nuts may be used in combination with studs 42 to fasten said extension members 28 and 30 firmly to mounting bar 40. Alternatively, speed nuts may be used to hold said channel member 44 in firm engagement with mounting bar 40 and thereby hold extensions 28 and 30 in the shaped configuration as is shown in FIG. 2.

In the preferred embodiment, a resilient bumper 50 is mounted within the astragal 20 and is affixed to bar 40. As is shown in FIG. 3, the bumper 50 may be secured to bar 40 by screw 52, but it may be affixed by other means which will be known to those skilled in the art such as various adhesive compositions. The primary function of bumper 50 is to prevent metal-to-metal contact when the doors are in the closed position. Although the bumper 50 may help to hold astragal 20 in a desired shape or configuration, the bumper is not required. However, it should be understood that the present invention is not limited to the use of any given number or style of bumpers, nor is it limited to the use of bumpers as a portion of the astragal.

A major advantage of the present invention is the use of studs 42 to hold the fabric assembly 21 in the shaped configuration of the astragal 20, and as the means to affix the astragal to door frame angle 16 on the upper door, whereby the astragal is mounted to the upper door. The use of a welded stud in this connection, avoids the need to drill and tap holes in the astragal member or in the door frame member. As is shown in FIG. 3, an elongated hole 15 in frame 14 may be used as the mounting means, in combination with the studs 42 and nut 43 to secure the astragal to the door 10.

Mounting bar 40 is provided with a plurality of studs 42 along the length thereof. The number of studs per linear distance along 40 may be varied over wide limits, but it has been found that one stud every two feet is adequate for ordinary installation. In the preferred embodiment, the channel is drilled at equal intervals with holes of sufficient size to accommodate the studs, although other types of apertures may be used. The extensions 28 and 30 of flexible fabric assembly 21 are provided with apertures at similar intervals.

The present invention is not limited to any particular type of flexible fireproof fabric to make up inner layer 22 and outer layer 24 of flexible fabric assembly 21. Various commercially available wire reinforced asbestos fabrics which are coated with neoprene, fluoro elastomers and other materials are satisfactory. While the metallic reinforced asbestos fabric is preferred, neoprene-coated asbestos fabric which is not reinforced with metal are also contemplated. It has been found that asbestos cloths of 1/16 inch thickness can be fabricated into astragals which will pass the underwriters tests when used in connection with the present invention. It is believed that the formation of an astragal having a dead air space between the inner layer 22 and outer layer 24, as is shown in FIG. 2, increases the fire resistance of the astragal.

The forms of invention herein shown and described are to be considered only as illustrative. It will be apparent to those skilled in the art that numerous modifications may be made therein without departure from the spirit of the invention or the scope of the appended claims.

What is claimed is:

1. An astragal for an elevator door, said astragal comprising an elongated envelope formed by joining an inner layer of flexible fire-resistant material and outer layer of flexible fire-resistant material, said outer layer being of greater dimension than said inner layer within the area of said envelope portion, said outer layer having exextensions on both sides beyond the area of said envelope portion, a mounting bar having door engaging means thereon adapted to attach said astragal to an elevator door, said envelope being shaped whereby said envelope forming joints are contiguous to said mounting bar, and said outer layer extensions being affixed to said mounting bar by said door engaging means.

2. An astragal as described in claim 1, which includes a resilient bumper affixed to said mounting bar, which bumper urges said astragal vertically downward.

3. An astragal as described in claim 1, wherein said envelope is formed by joining said inner layer to said outer layer by stitching.

4. An astragal as described in claim 1, wherein said door engaging means comprise a plurality of threaded studs welded to said mounting bar.

5. An astragal as described in claim 4, wherein said outer layer extensions are affixed to said mounting bar by said studs.

6. An astragal as described in claim 5, wherein speed nuts are applied to studs to affix said extensions to said mounting bar.

7. An astragal as described in claim 1, which includes a channel member affixed to said mounting bar by said door engaging means, said channel member having skirt members which overlap said envelope forming joints.

8. An astragal as described in claim 7, which includes a resilient bumper affixed to said mounting bar, which bumper urges said astragal vertically downward.

9. An astragal as described in claim 7, wherein said envelope is formed by joining said inner layer to said outer layer by stitching.

10. An astragal as described in claim 7, wherein said door engaging means comprise a plurality of threaded studs welded to said mounting bar.

11. An astragal as described in claim 10, wherein said outer layer extensions are affixed to said mounting bar by said studs.

12. An astragal as described in claim 11, wherein speed nuts are applied to studs to affix said extensions to said mounting bar.

* * * * *